US011568848B2

(12) United States Patent
Lee et al.

(10) Patent No.: US 11,568,848 B2
(45) Date of Patent: Jan. 31, 2023

(54) AIRBORNE ACOUSTIC ABSORBER

(71) Applicant: Toyota Motor Engineering & Manufacturing North America, Inc., Plano, TX (US)

(72) Inventors: Taehwa Lee, Ann Arbor, MI (US); Hideo Iizuka, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 1315 days.

(21) Appl. No.: 15/965,149

(22) Filed: Apr. 27, 2018

(65) Prior Publication Data

US 2019/0333492 A1 Oct. 31, 2019

(51) Int. Cl.

| | |
|---|---|
| ***G10K 11/172*** | (2006.01) |
| ***E01F 8/00*** | (2006.01) |
| ***E04B 1/84*** | (2006.01) |

(52) U.S. Cl.

CPC ..... *G10K 11/172* (2013.01); *E01F 8/0023* (2013.01); *E01F 8/0082* (2013.01)

(58) Field of Classification Search

CPC ..... G10K 11/172; G10K 11/16; E01F 8/0023; E01F 8/0082; E01F 8/00; E01F 8/0005; E01F 8/0029; E01F 8/0052; E01F 8/0058; E01F 8/0064; E01F 8/007; E01F 8/0076; E04B 1/84; E04B 2001/8485; E04B 2001/8476

See application file for complete search history.

(56) References Cited

U.S. PATENT DOCUMENTS 2,007,130 A * 7/1935 Munroe ..... E04B 1/86 52/145
2,840,179 A * 6/1958 Junger ..... E04B 1/8409 181/286
3,275,101 A * 9/1966 Davis, Jr. ..... E04C 2/044 181/285
3,506,089 A * 4/1970 Junger ..... E04B 1/8404 52/145
3,837,426 A * 9/1974 Kleinschmidt ..... E04B 1/8404 52/145

(Continued)

FOREIGN PATENT DOCUMENTS

FR 2624640 A1 * 6/1989 ..... G10K 11/02
FR 2700179 A1 * 7/1994 ..... E01F 8/0076

(Continued)

OTHER PUBLICATIONS

Selamet, A. et al., "Helmholtz resonator lined with absorbing material", J. Acoust. Soc. Am., 117, pp. 725-733 (2005).

(Continued)

*Primary Examiner* — Edgardo San Martin
(74) *Attorney, Agent, or Firm* — Christopher G. Darrow; Darrow Mustafa PC

(57) ABSTRACT

Airborne acoustic absorbers include periodic arrays of Helmholtz resonators that are covered and/or partially filled with an acoustically absorptive material, such as a thermoplastic foam. The combined structures have much broader frequency ranges of high acoustic absorption than do structures having only Helmholtz resonators or acoustically absorbing foam.

13 Claims, 9 Drawing Sheets

(56) References Cited

U.S. PATENT DOCUMENTS

| | | | | |
|---|---|---|---|---|
| 3,866,001 | A * | 2/1975 | Kleinschmidt | E04B 1/8404 52/145 |
| 3,887,031 | A * | 6/1975 | Wirt | G10K 11/172 181/292 |
| 3,983,955 | A * | 10/1976 | Vasiljevic | G10K 11/172 428/116 |
| 4,135,603 | A * | 1/1979 | Dean, III | G10K 11/172 428/116 |
| 4,562,901 | A * | 1/1986 | Junger | E04B 1/8404 181/288 |
| 7,520,369 | B2 * | 4/2009 | Dravet | B64D 29/00 181/290 |
| 7,913,813 | B1 * | 3/2011 | Mathur | G10K 11/172 181/290 |
| 9,623,952 | B1 * | 4/2017 | Jones | B64C 9/18 |
| 2003/0006090 | A1 * | 1/2003 | Reed | E01F 8/007 181/290 |
| 2006/0169531 | A1 | 8/2006 | Volker | |
| 2017/0263235 | A1 * | 9/2017 | Elford | G10K 11/172 |
| 2020/0066245 | A1 * | 2/2020 | Lee | G10K 11/162 |
| 2020/0284174 | A1 * | 9/2020 | Lee | F28F 3/02 |
| 2021/0207508 | A1 * | 7/2021 | Linke | F01N 1/02 |
| 2021/0280161 | A1 * | 9/2021 | Lee | G10K 11/168 |

FOREIGN PATENT DOCUMENTS

| | | | | |
|---|---|---|---|---|
| FR | 2929746 | A1 * | 10/2009 | B60R 13/08 |
| WO | WO-2018047153 | A1 * | 3/2018 | |

OTHER PUBLICATIONS

Jimenez, N. et al., "Rainbow-trapping absorbers: Broadband, perfect and asymmetric sound absorption by subwavelength panels for transmission problems," Scientific Reports, 7: 13595, pp. 1-12 (2017).

Tang, Y. et al., "Hybrid acoustic metamaterial as super absorber for broadband low-frequency sound," Scientific Reports, 7: 43340 pp. 1-11 (2017).

Yang, M. et al., "Optimal Sound-Absorbing Structures," Material Horizon, pp. 1-22 (2017).

Lagarrigue, C., et al., "Absorption of sound by porous layers with embedded periodic arrays of resonant inclusions", J. Acoust. Soc. Am. 134 (6), Pt. 2, pp. 4670-4680 (2013).

Groby, J.-P., et al., "Enhancing the absorption properties of acoustic porous plates by periodically embedding Helmholtz resonators," J Acoust. Soc. Am. 137 (1) pp. 273-280 (2015).

* cited by examiner

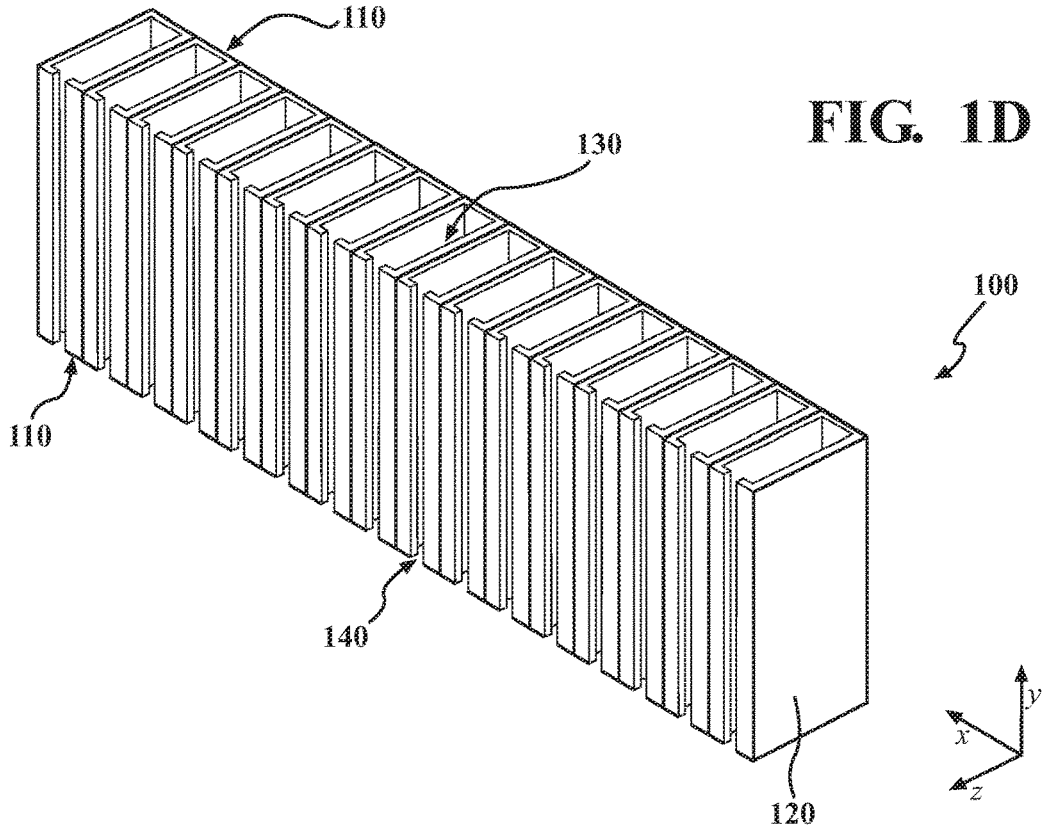
FIG. 1D
FIG. 1E
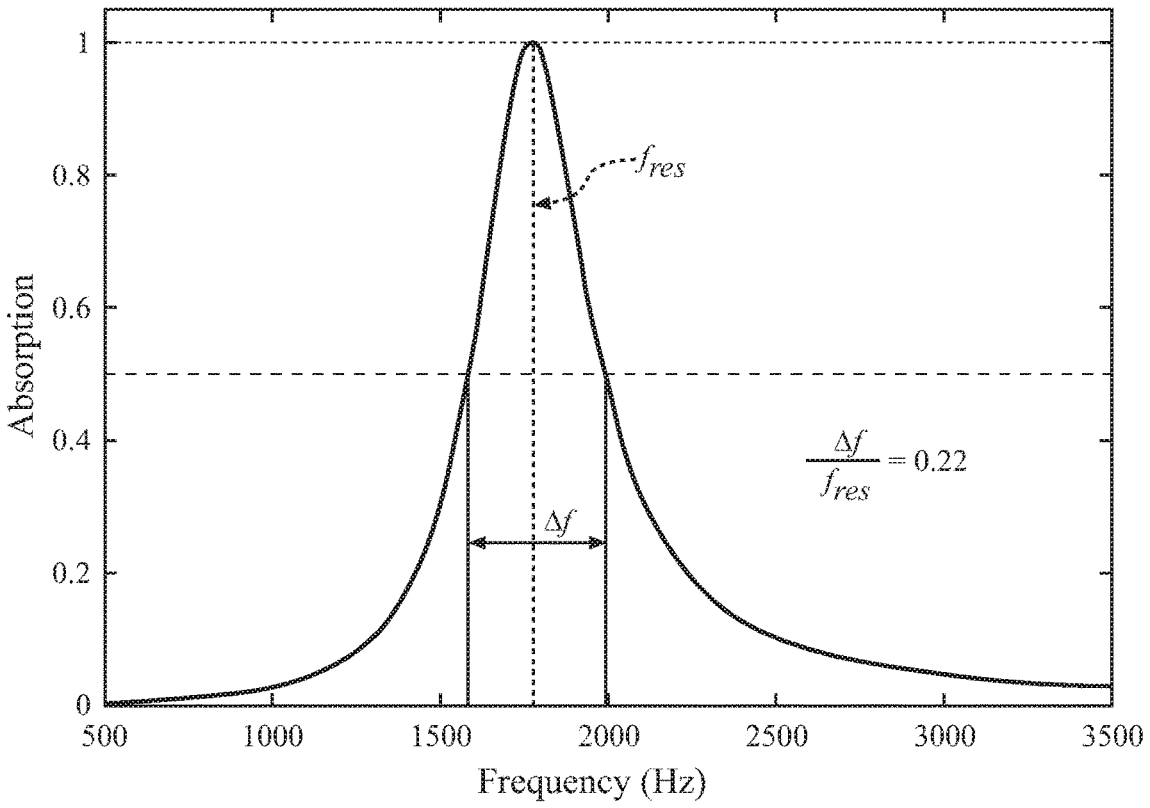

AIRBORNE ACOUSTIC ABSORBER

TECHNICAL FIELD

The present disclosure generally relates to acoustic metamaterials and, more particularly, to acoustic metamaterials that absorb airborne sound.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Viscous materials that absorb airborne acoustic waves are useful for sound mitigation in a variety of contexts. Such materials typically need to be very thick in order to achieve high efficiency absorption, however. Metasurfaces incorporating resonant structures can achieve high absorption with lower thickness, but typically have a narrow frequency range of high efficiency absorption. Some metamaterials are known combining the attributes of viscous absorbers and resonant structures, but are often very structurally complex and frequently still suffer from limited frequency range.

Accordingly, it would be desirable to provide an improved acoustic absorption metamaterial for the absorption of airborne acoustic waves, having a simple design and providing broadband absorption efficiency.

SUMMARY

This section provides a general summary of the disclosure, and is not a comprehensive disclosure of its full scope or all of its features.

In various aspects, the present teachings provide an airborne acoustic absorber having an absorption frequency range. The absorber includes a periodic array of unit cells, each unit cell having a Helmholtz resonator having a resonant frequency. Each Helmholtz resonator includes a chamber portion bounded by at least one enclosure wall defining a chamber volume; and a neck, forming an aperture in the at least one enclosure wall, and defining an opening to the chamber portion. Each unit cell further includes an acoustically absorbing medium overlaying the neck, thereby increasing the resonant frequency bandwidth to achieve the absorption frequency range.

In other aspects, the present teachings provide a multi-resonance airborne acoustic absorber. The multi-resonance airborne acoustic absorber includes a periodic array of unit cells. Each unit cell of the periodic array includes a first Helmholtz resonator having: a first chamber portion bounded by at least one first enclosure wall defining a first chamber volume; and a first neck forming an aperture in the at least one first enclosure wall. Each unit cell also includes a second Helmholtz resonator having: a second chamber portion bounded by at least one second enclosure wall defining a second chamber volume; and a second neck forming an aperture in the at least one second enclosure wall. Each unit cell also includes an acoustically absorbing medium overlaying at least the first and second necks. The first and second chamber volumes are different from one another.

In still other aspects, the present teachings provide a highway sound barrier. The highway sound barrier includes a substantially planar or curved substrate and an airborne acoustic absorber coating a surface of the substrate. The absorber includes a periodic array of unit cells, each unit cell comprising a first Helmholtz resonator having a resonant frequency. Each first Helmholtz resonator of the periodic array includes: a first chamber portion bounded by at least one first enclosure wall defining a first chamber volume; and a first neck forming an aperture in the at least one first enclosure wall. Each unit cell also includes an acoustically absorbing medium overlaying at least the first and second necks.

Further areas of applicability and various methods of enhancing the disclosed technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein:

FIG. 1D is a perspective view of the metasurface of FIG. 1C;

FIG. 1E is a graph of acoustic absorption properties of the acoustic metasurface of FIG. 1A;

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The invention provides structures that absorb sound waves in air, across a greater frequency range than do existing acoustic absorbers.

The airborne acoustic absorbers of the present teachings include periodic arrays of Helmholtz resonators that are covered and/or partially filled with an acoustically absorptive materials, such as a thermoplastic foam. The combined structures have much broader frequency ranges of high acoustic absorption than do structures having only Helmholtz resonators or acoustically absorbing foam.

Figure 1A:
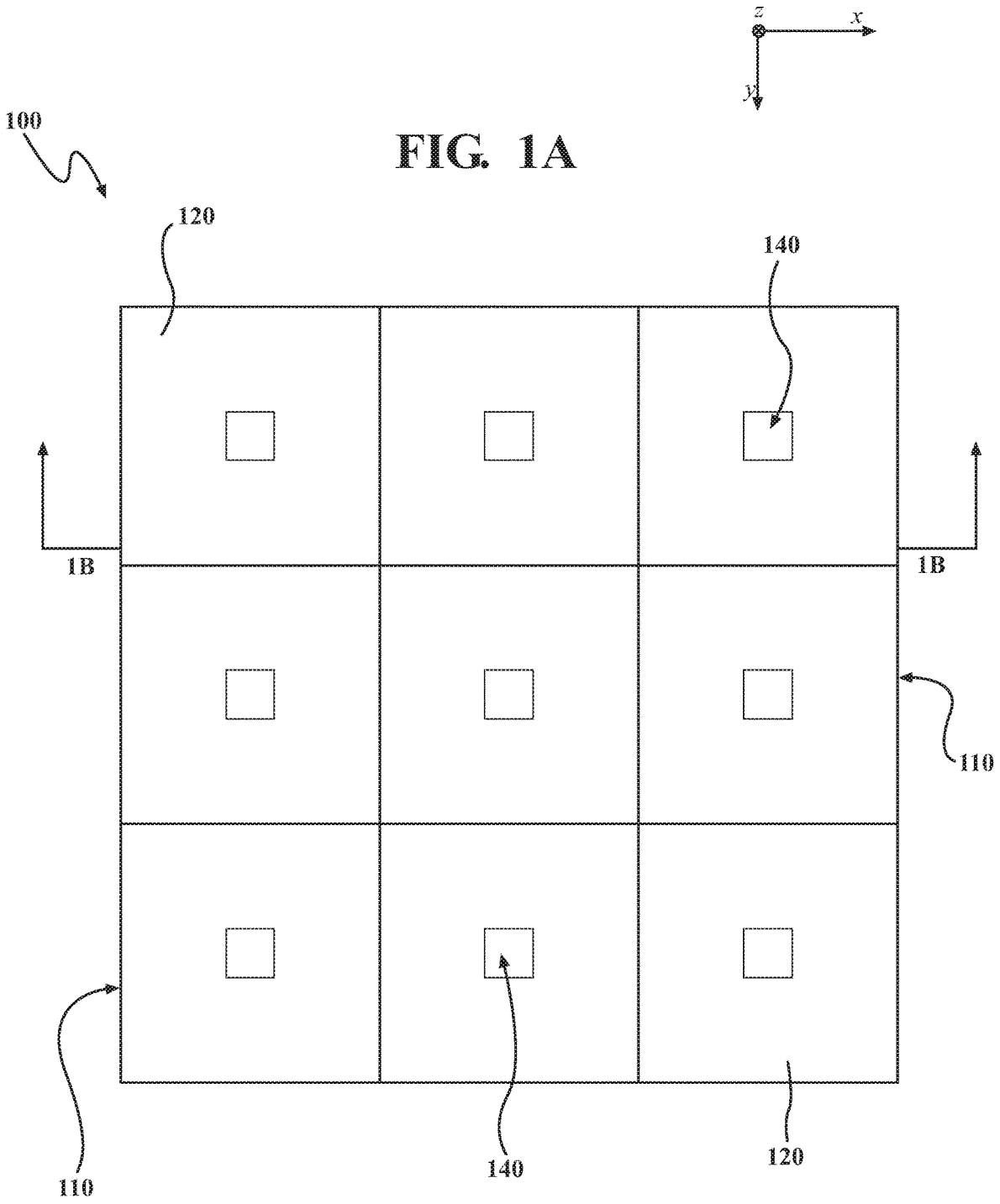
FIG. 1A is a top plan view of a 3×3 portion of a periodic array of Helmholtz resonators of an acoustic metasurface.
Figure 1B:
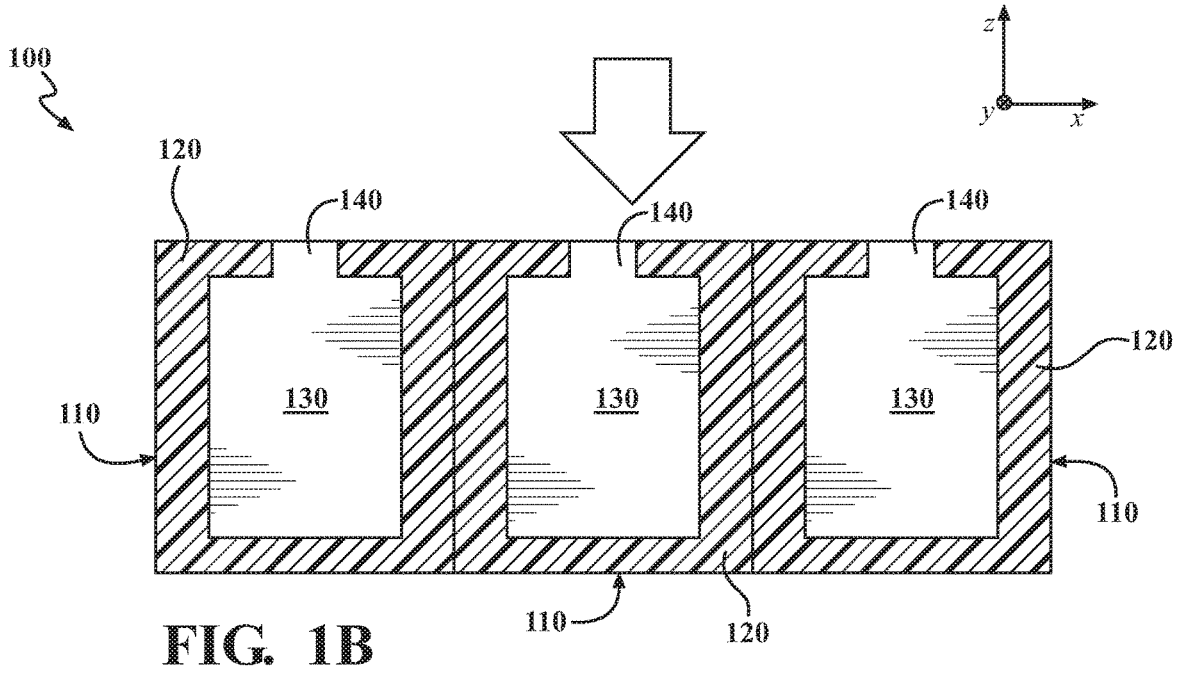
FIG. 1B is a side cross-sectional view of a portion of the array of FIG. 1A, viewed along the line 1B-1B.

FIG. 1A shows a top plan view of a portion of an acoustic metasurface 100 having an array of periodic Helmholtz resonators 110. FIG. 1B shows a side cross-sectional view of the acoustic metasurface 100, viewed along the line 1B-1B of FIG. 1A. Each Helmholtz resonator 110 includes at least one enclosure wall 120 enveloping a chamber 130. Each Helmholtz resonator 110 further includes a neck 140, the neck 140 forming an aperture penetrating the at least one enclosure wall 120 to the chamber 130. The Helmholtz resonators 110 can be periodic in only one-dimension, but will typically be periodic in two-dimensions (e.g. x,y), as in the example of FIG. 1A. Each Helmholtz resonator 110 includes at least one enclosure wall, although the at least one enclosure wall 120 of Helmholtz resonator 110 of FIGS. 1A-1B can be considered to include multiple side walls and end walls. Each Helmholtz resonator 110 further includes a neck 140, defining an aperture passing through the at least one enclosure wall 120. Each Helmholtz resonator 110 of the array of periodic Helmholtz resonators 110 includes a chamber 130, respectively, bounded by the at least one enclosure wall 120.

While the Helmholtz resonator 110 of FIGS. 1A and 1B defines a substantially rectangular prismatic shape, it is to be understood that a Helmholtz resonator 110 of the present teachings can include any suitable shape, such as cylindrical, conical, spherical, ovoid, or any other shape that is suitable to enclose each Helmholtz resonator 110. In general, the maximum width of a chamber 130 will be substantially greater than the maximum width of its associated neck 140.

It will further be understood that each chamber 130 defines a volume, corresponding to the volume of air that can be held in the chamber 130, exclusive of the neck 140. Each chamber 130 can further be characterized as having a maximum longitudinal dimension, in the z-dimension of FIG. 1B, and a maximum lateral dimension, in the x-dimension of FIG. 1B.

Figure 1C:
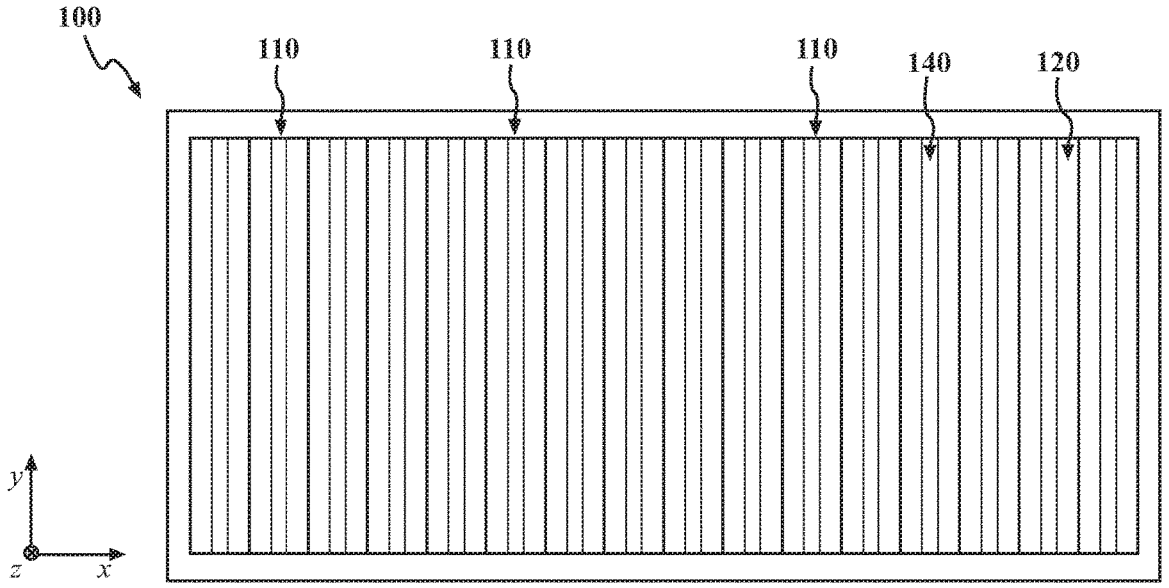
FIG. 1C is a top plan view of an acoustic metasurface having a one-dimensional periodic array of Helmholtz resonators.

As noted above, and illustrated in FIGS. 1C and 1D, an acoustic metasurface 100 of the present teachings can optionally have Helmholtz resonators 110 that are periodic in one dimension only. FIG. 1C shows a top plan view of such a one-dimensional periodic array of Helmholtz resonators 110, periodic in the x-dimension, and FIG. 1D shows a perspective view of the acoustic metasurface 100 of FIG. 1C. As shown in the example of FIGS. 1C and 1D, when the acoustic metasurface 100 has Helmholtz resonators 110 that are periodic in one-dimension (e.g. the x-dimension), each Helmholtz resonator 110 will typically be elongated in the y-dimension.

The at least one enclosure wall 120 will typically be formed of a solid, sound reflecting material. In general, the material or materials of which the at least one enclosure wall 120 are formed will have acoustic impedance higher than that of air. Such materials can include a thermoplastic resin, such as polyurethane, a ceramic, or any other suitable material.

As will be understood by those of skill in the art, a conventional Helmholtz resonator 110, such as that forming the array of periodic Helmholtz resonators 110 of FIGS. 1A and 1B, possesses an intrinsically narrow resonance frequency range. FIG. 1E shows a graph of acoustic response, across a frequency range, of a metasurface having an array of periodic Helmholtz resonators 110 of the type shown in FIGS. 1A and 1B. As will be understood to those of skill in the art, and as can be seen from FIG. 1E, the acoustic metasurface 100 composed of conventional Helmholtz resonators 110 has a substantially narrow acoustic absorption range. In particular, the acoustic metasurface 100 has a frequency range of detectable absorption covering about 3 KHz, centered at a resonance frequency, $f_{res}$, at about 1750 Hz. However, the frequency range across which the acoustic metasurface 100 exhibits acoustic absorption greater than 0.5, or 50%, ($\Delta f$) is less than 500 Hz in breadth, so that $\Delta f/f_{res}$ is about 0.22. In short, the acoustic metasurface 100 of FIG. 1A having an array of conventional Helmholtz resonators 110 has a substantially narrow acoustic absorption frequency band. It will be appreciated that, in the example of FIGS. 1A and 1B, the period of the array and the maximum lateral dimension, or width, of the unit cell is the same, so that each Helmholtz resonator 110 is in contact with each adjacent Helmholtz resonator. It should be understood that in some variations, the period can exceed the maximum lateral dimension of the unit cell, so that there is a space between adjacent Helmholtz resonators 110.

Figure 2A:
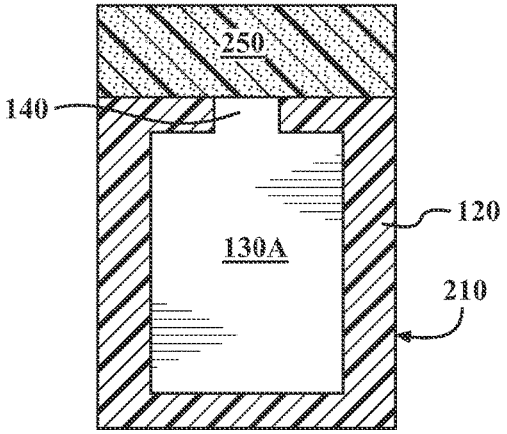
FIGS. 2A-2C are three variations of modified Helmholtz resonators that can be incorporated into a periodic array of the type shown in FIG. 1A to produce an airborne acoustic absorber of the present teachings.
Figure 2B:
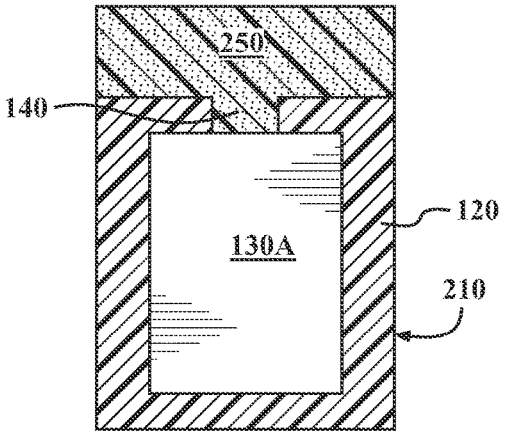
Figure 2C:
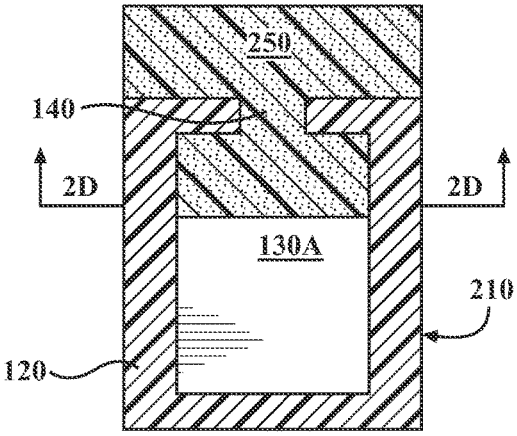

FIGS. 2A-2C show three variations of modified Helmholtz resonators 210 that can be employed in an airborne acoustic absorber of the present teachings. An airborne acoustic absorber of the present teachings has an array of modified Helmholtz resonators, arrayed in the manner described above and illustrated in FIGS. 1A and 1B. However, the individual unit cells of the array, the Helmholtz resonators 210 of FIGS. 2A-2C are modified as described below.

In the variation shown in FIG. 2A, each modified Helmholtz resonator 210 forming the array in the airborne acoustic absorber includes an acoustically absorbing medium 250 overlaying the Helmholtz resonators 210. In some such variations, the acoustically absorbing medium 250 can overlay, in x,y dimensions, the top surface of the entire array of Helmholtz resonators 210; and in some variations can overlay the neck 140 of each Helmholtz resonator 210. In many such variations, the acoustically absorbing medium 250 can have a have a thickness in the z dimension that is less than the wavelength, or less than one quarter of the wavelength, corresponding to the resonance frequency, $f_{res}$, of the airborne acoustic absorber. In some implementations, the absorbing layer 310 will have a thickness less than about 20 mm, or less than about 10 mm, or less than or equal to about 5 mm.

Figure 2D:
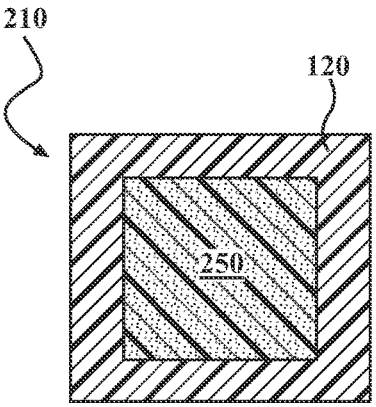
FIG. 2D is a side cross-sectional view of the Helmholtz resonator of FIG. 2C, viewed along the line 2D-2D.

In the variation shown in FIG. 2B, the acoustically absorbing medium 250 overlays each Helmholtz resonator 210 as described above, but also penetrates into and contiguously fills at least a portion of the neck 140, as illustrated. In the example of FIG. 2B, the acoustically absorbing medium 250 fills the entire neck 140. In the variation shown in FIG. 2C, the acoustically absorbing medium 250 overlays each Helmholtz resonator 210 and contiguously fills the neck 140, as described above, and also fills an adjacent portion of the chamber 130. The term, "contiguously" as used above means that the acoustically absorbing medium 250 portions that overlay the Helmholtz resonators 210, optionally fill at least a portion of the neck 140, and optionally fill at least a portion of the chamber 130, are continuous. Filling of the neck 140 and/or chamber 130 as described above is such that the acoustically absorbing medium runs uniformly across the Helmholtz resonator 210 in the x-dimension at the desired depth in the y-dimension, rather than merely coating the sided of the Helmholtz resonator 210. An illustrative example of such filling is shown in FIG. 2D, a cross-sectional view of the Helmholtz resonator 210 of FIG. 2C viewed along the line 2D-2D.

It will be understood that the resonance frequency, fres, of a Helmholtz resonator 110, including a modified Helmholtz resonator of any of the types described above, is determined according to Equation I:

$$f_{res} = \frac{c}{2\pi}\sqrt{\frac{S}{Vl}}. \quad \text{I}$$

where c is the speed of sound in air, S is the area of neck 140 opening (in the plane of the x-y dimensions of FIGS. 1A-1D and 2A-2C), V is the volume of chamber 130, and l is the length of the neck 140 (along the z-dimension of FIGS. 1A-1D and 2A-2C).

The acoustically absorbing medium 250 can be a highly absorptive porous medium, such as melamine foam, or any other medium having thermal dissipative acoustic properties. In some implementations, the absorptive porous medium will have a porosity greater than 0.5 or 0.6, or 0.7, or 0.8 or 0.9. It will be understood that, while the acoustically absorbing medium 250, by itself, would have to be very thick in order to achieve substantial acoustic absorption, the combinations of acoustically absorbing medium 250 and Helmholtz resonator 210 as described above provide a broad band acoustic absorption with high efficiency despite the layer of acoustically absorbing medium 250 being relatively thin. The combination of a Helmholtz resonator with a thin layer of foam results in a structure that possesses strong acoustic absorbance across a broad frequency range. Thus, the two components, the acoustically absorbing medium 250 and the Helmholtz resonator 210, have a synergistic effect.

Figure 2E:
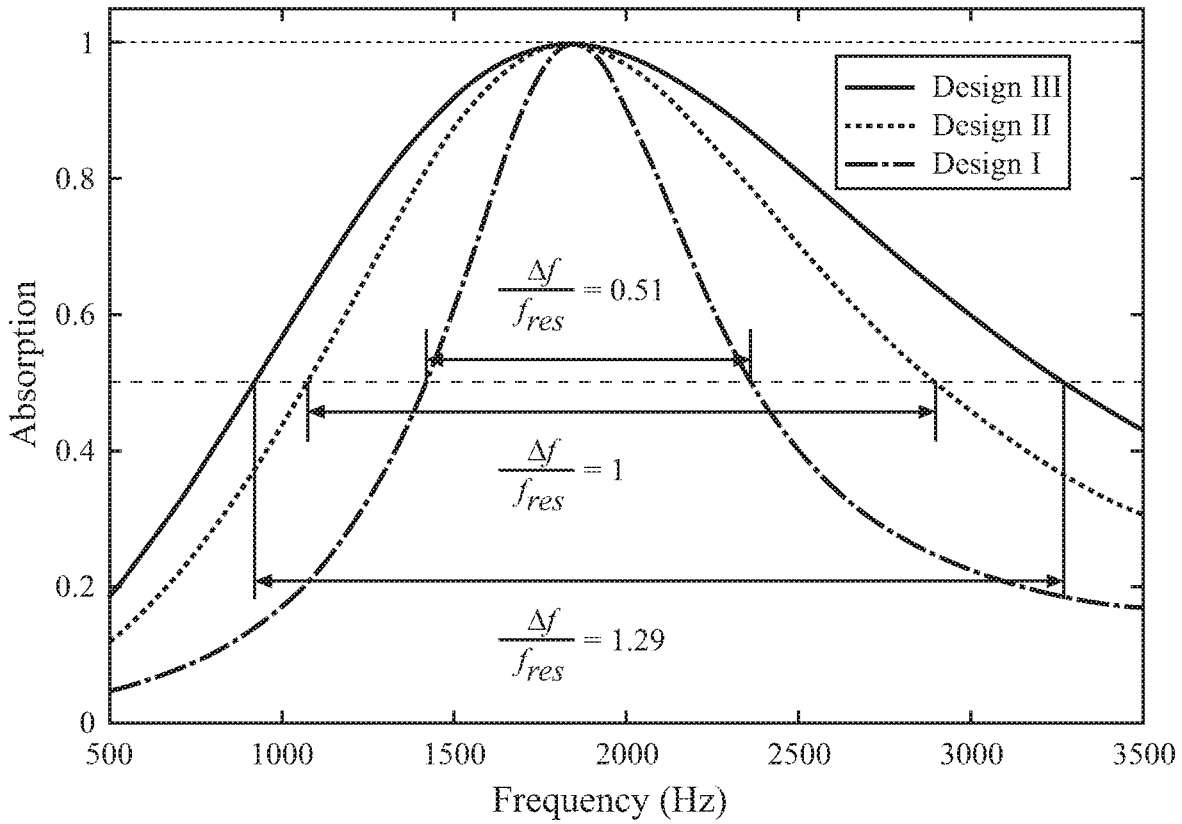
FIG. 2E is a graph of acoustic absorption properties of airborne acoustic absorbers having the Helmholtz resonators of FIG. 2A, 2B, or 2C.

FIG. 2E shows acoustic absorption results for airborne acoustic absorbers having modified Helmholtz resonators 210, where Designs I, II, and III correlate to the examples of FIGS. 2A, 2B, and 2C, respectively. The results of FIG. 2E clearly show that the airborne acoustic absorbers of the present teachings, utilizing unit cells composed of modified Helmholtz resonators of FIGS. 2A-2C, have much broader acoustic absorption characteristics than does the acoustic metasurface 100 of FIG. 1A having unmodified Helmholtz resonators 110. In particular, the airborne acoustic absorber having an array of modified Helmholtz resonators 210 including the acoustically absorbing medium 250 overlaying and filling the neck 140 of the modified Helmholtz resonator 210, and filling a portion of the chamber 130 adjacent to the neck 140, has the broadest acoustic absorption, with $\Delta f/f_{res}$ of 1.29. The airborne acoustic absorber having an array of modified Helmholtz resonators 210 including the acoustically absorbing medium 250 overlaying and filling the neck 140 of the modified Helmholtz resonator 210 has the second broadest acoustic absorption, with $\Delta f/f_{res}$ of 1. The airborne acoustic absorber having an array of modified Helmholtz resonators 210 including the acoustically absorbing medium 250 overlaying the neck 140 of the modified Helmholtz resonator 210 has the third broadest acoustic absorption, still much broader than that of the acoustic metasurface having standard Helmholtz resonators 110, with $\Delta f/f_{res}$ of 0.51.

Figure 3A:
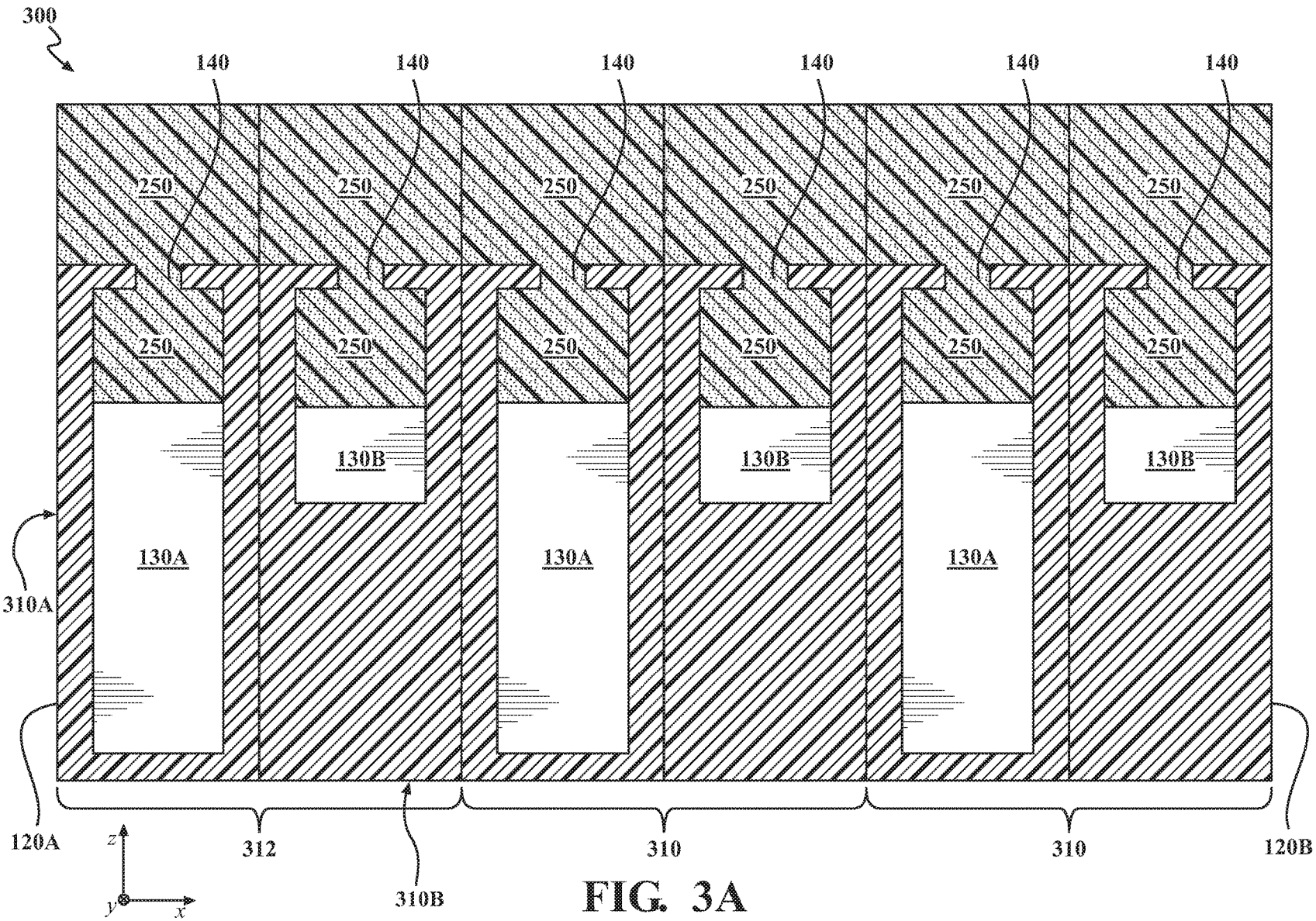
FIG. 3A is a side cross-sectional view similar to that of FIG. 1B, and showing a multi-resonance airborne acoustic absorber having modified Helmholtz resonators of alternating chamber volume.
Figure 3B:
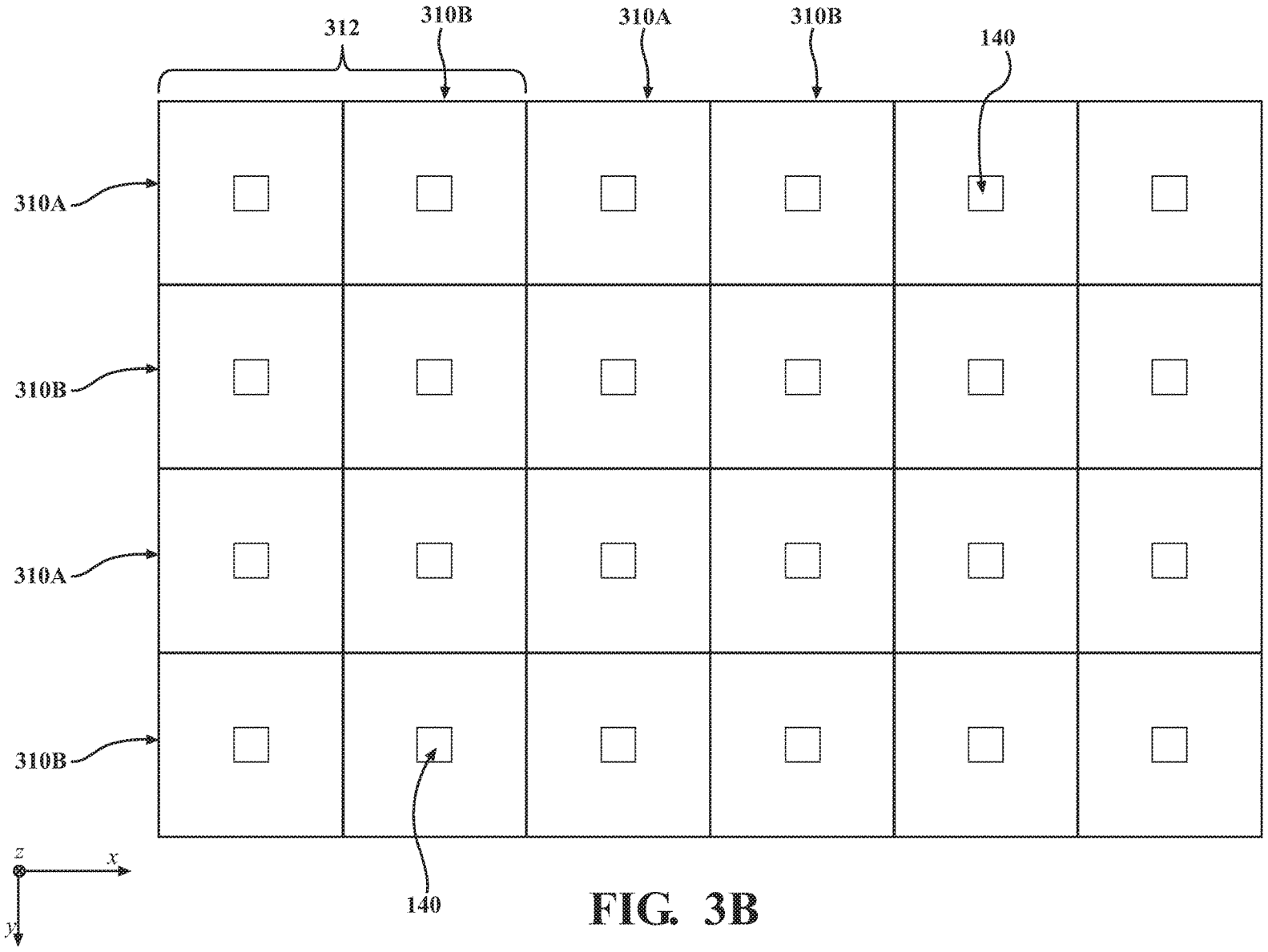
FIG. 3B is a top plan view of a 6×4 portion of the multi-resonance airborne acoustic absorber of FIG. 3A.

FIG. 3A shows a side cross-sectional view of a multi-resonance airborne acoustic absorber 300, representing a further extension of the present teachings, and viewed along a line of sight analogous to that in FIG. 1B for the acoustic metasurface 100 having unmodified Helmholtz resonators 110. FIG. 3B shows a top plan view of a portion of the absorber 300 of FIG. 1A. The multi-resonance airborne acoustic absorber of FIGS. 3A and 3B is similar to the modified airborne acoustic absorber as described above, except that the unit cell 312 of the array includes at least two Helmholtz resonators 310A, 310B having different volume. In the example of FIGS. 3A and 3B, the first and second Helmholtz resonators 310A, 310B have differing first and second volumes due to differing maximum longitudinal dimensions, however the differing volumes could be due to differing maximum lateral dimensions or any other relevant factor. Further, while the exemplary airborne acoustic resonator of FIGS. 3A and 3B has a unit cell with two (i.e. first and second) Helmholtz resonators 310A, 310B having differing volumes, in different embodiments an airborne acoustic absorber of the present teachings can have a unit cell with three, or any larger number, of Helmholtz resonators with differing chamber volume.

Figure 3C:
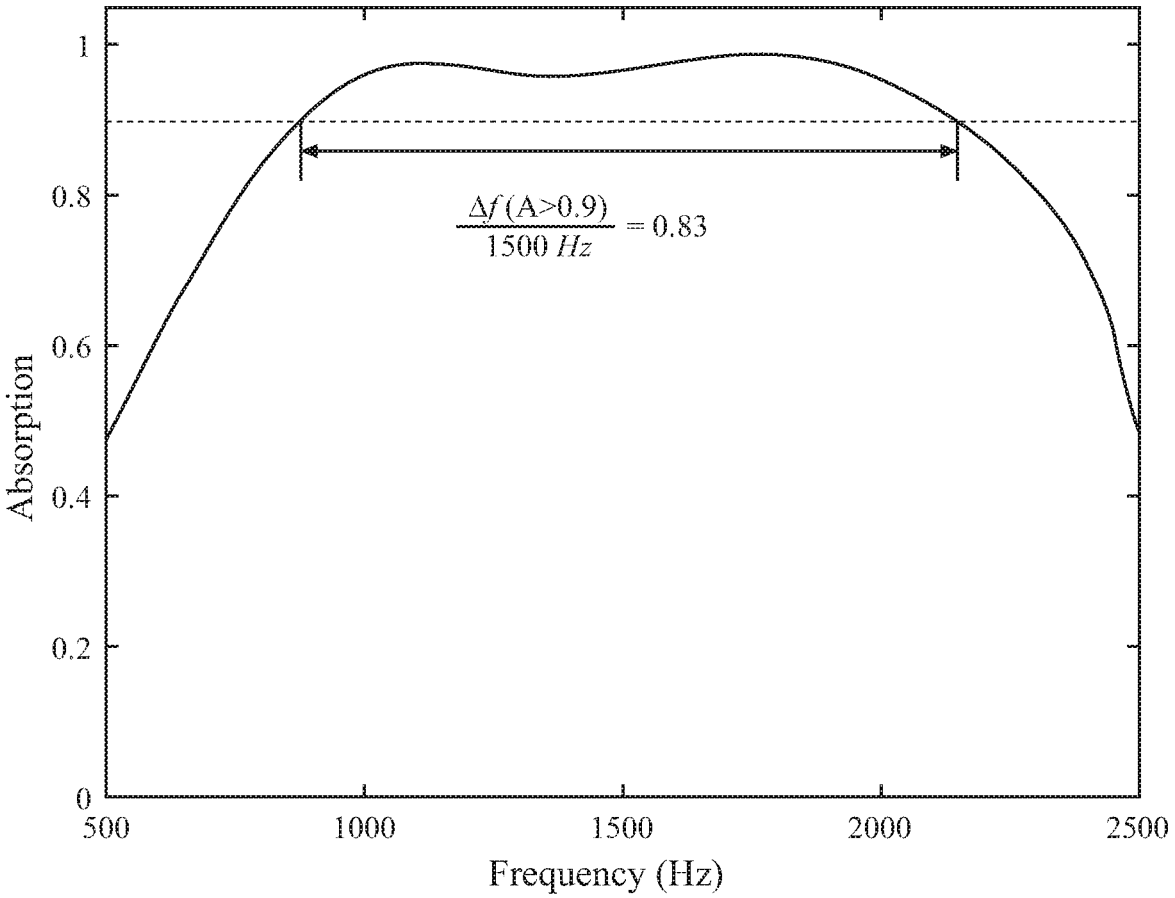
FIG. 3C is a graph of acoustic absorption properties of the multi-resonance airborne acoustic absorber of FIGS. 3A and 3B.

FIG. 3C shows acoustic absorption results for the multi-resonance airborne acoustic absorber 300 of FIGS. 3A and 3B. As shown in the results of FIG. 3C, the multi-resonance airborne acoustic absorber 300 of FIG. 3A has extremely broad acoustic absorption, with an absorbance greater than 0.9 across a frequency range $\Delta f(A>0.9)$ over 1000 Hz.

Figure 4:
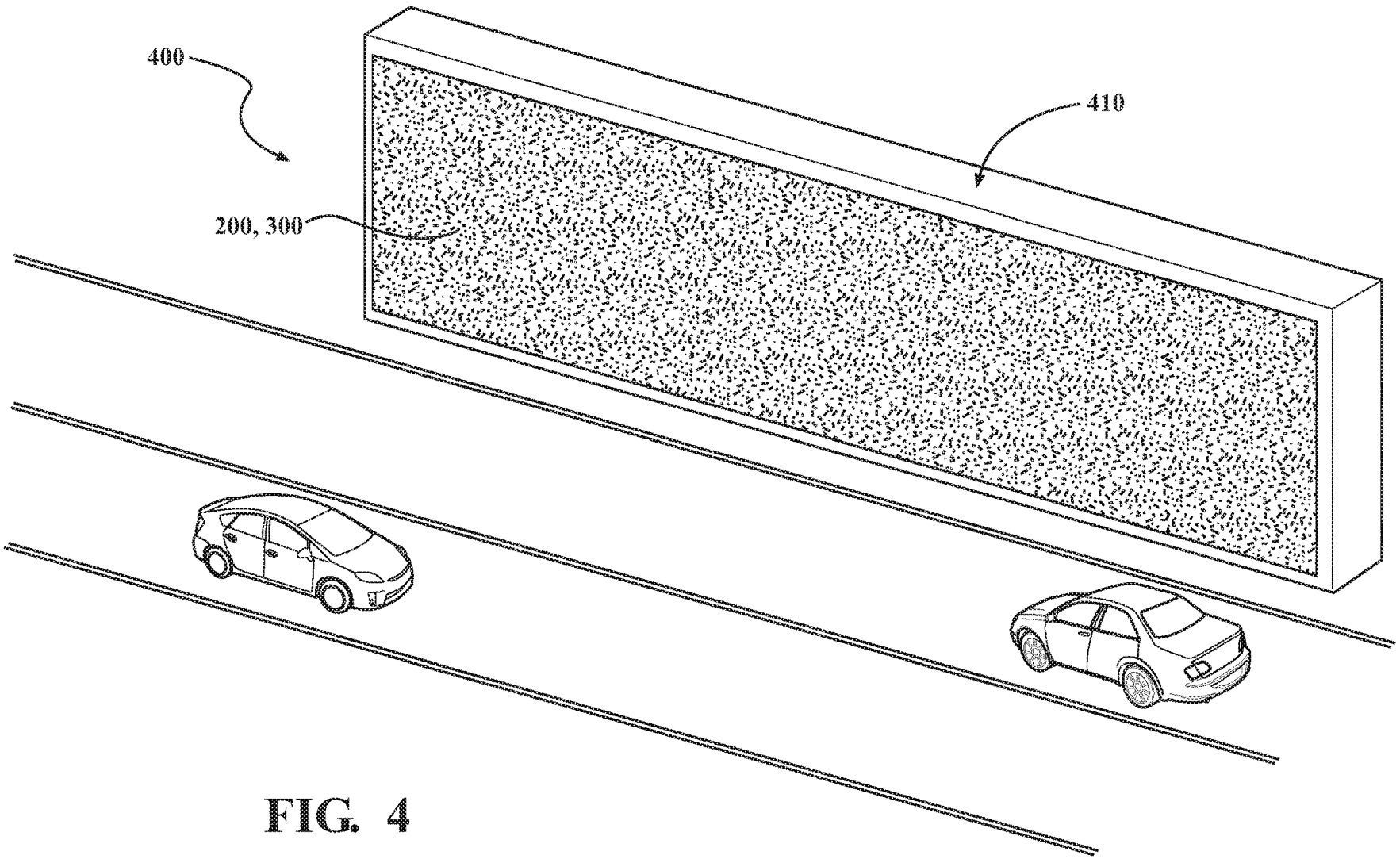
FIG. 4 is a perspective view of a sound barrier equipped with a sound suppression system of the present teachings, and deployed on the side of a vehicle highway.

FIG. 4 shows an example of an additionally disclosed sound suppression system 400 having an airborne acoustic absorber 200, 300 of the present teachings. Such a sound suppression system 400 includes a substantially planar or curved substrate 410, such as a wall or other obstacle. The substantially planar substrate 410 is covered on at least one surface with an airborne acoustic absorber 200 or multi-resonance airborne acoustic absorber 300 of the present teachings. In one non-limiting example, and as shown in FIG. 4, a highway sound barrier can be coated with an airborne acoustic absorber 200 or multi-resonance airborne acoustic absorber 300 of the present teachings. It will be understood that highways are often lined with walls or other structures made of concrete or other substantially sound-reflective materials, to protect adjacent residential areas from the highway noise. However, such barriers frequently merely reflect highway noise to the opposite side and, when opposing barriers are present on both sides of a highway, create an echo tunnel across the highway that interferes with noise abatement. It will be appreciated that coating of such walls with airborne acoustic absorbers of the present teachings will minimize such problems.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. An airborne acoustic absorber having an absorption frequency range, airborne acoustic the absorber comprising:
- a periodic array of unit cells, each unit cell comprising:
  - a Helmholtz resonator having a resonant frequency, each Helmholtz resonator comprising:
    - a chamber portion bounded by at least one enclosure wall defining a chamber volume; and
    - a neck, forming an aperture in the at least one enclosure wall, and defining an opening to the chamber portion; and
  - an acoustically absorbing medium overlaying the neck and contiguously filling at least a portion of the neck, thereby increasing the resonant frequency bandwidth to achieve the absorption frequency range, the acoustically absorbing medium having a porosity greater than 0.9, the acoustically absorbing medium having a thickness that is less than a wavelength corresponding to the resonance frequency of the airborne acoustic absorber,
- the airborne acoustic absorber having acoustic absorption of at least about 1.

2. The airborne acoustic absorber as recited in claim 1, wherein the acoustically absorbing medium contiguously fills an adjacent portion of the chamber portion.

3. The airborne acoustic absorber as recited in claim 1, wherein the acoustically absorbing medium comprises melamine foam.

4. A multi-resonance airborne acoustic absorber comprising a periodic array of unit cells, each unit cell comprising:
- a first Helmholtz resonator having:
  - a first chamber portion bounded by at least one first enclosure wall defining a first chamber volume; and
  - a first neck forming an aperture in the at least one first enclosure wall; and
- a second Helmholtz resonator having:
  - a second chamber portion bounded by at least one second enclosure wall defining a second chamber volume; and
  - a second neck forming an aperture in the at least one second enclosure wall; and
  - an acoustically absorbing medium overlaying at least the first and second necks and contiguously filling at least a portion of the first and second necks, the acoustically absorbing medium having a porosity greater than 0.9, the acoustically absorbing medium having a thickness that is less than a wavelength corresponding to the resonance frequency of the multi-resonance airborne acoustic absorber,
- the multi-resonance airborne acoustic absorber having acoustic absorption of at least about 1.

5. The multi-resonance airborne acoustic absorber as recited in claim 4, wherein the acoustically absorbing medium contiguously fills an adjacent portion of the first and second chamber portions.

6. The multi-resonance airborne acoustic absorber as recited in claim 4, wherein the acoustically absorbing medium comprises melamine foam.

7. The multi-resonance airborne acoustic absorber as recited in claim 4, wherein the first chamber volume and the second chamber volume are different.

8. A highway sound barrier comprising:
- a substantially planar or curved substrate, the substantially planar or curved substrate being a highway sound barrier; and
- an airborne acoustic absorber coating a surface of the substantially planar or curved substrate, the airborne acoustic absorber comprising:
  - a periodic array of unit cells, each unit cell comprising
    - a first Helmholtz resonator having a resonant frequency, each first Helmholtz resonator of the periodic array comprising:
      - a first chamber portion bounded by at least one enclosure wall defining a first chamber volume; and
      - a first neck, forming an aperture in the at least one enclosure wall, and defining an opening to the first chamber portion; and
  - an acoustically absorbing medium overlaying the first neck and contiguously filling at least a portion of the first neck, thereby producing an absorption frequency greater than the resonant frequency, the acoustically absorbing medium having a porosity greater than 0.9, the acoustically absorbing medium having a thickness that is less than a wavelength corresponding to the resonance frequency of the airborne acoustic absorber,
- the airborne acoustic absorber having acoustic absorption of at least about 1.

9. The highway sound barrier as recited in claim 8, wherein the acoustically absorbing medium contiguously fills an adjacent portion of the first chamber portion.

10. The highway sound barrier as recited in claim 8, wherein the acoustically absorbing medium comprises melamine foam.

11. The highway sound barrier as recited in claim 8, wherein each unit cell comprises a second Helmholtz resonator having:

a second chamber portion bounded by at least one second enclosure wall defining a second chamber volume; and a second neck forming an aperture in the at least one second enclosure wall.

12. The highway sound barrier as recited in claim 11, wherein the first chamber volume and the second chamber volume are different.

13. The airborne acoustic absorber as recited in claim 1, wherein the acoustically absorbing medium has a thickness that is less than one quarter of the wavelength corresponding to the resonance frequency of the airborne acoustic absorber.

* * * * *